US009404492B2

(12) United States Patent
Reimann et al.

(10) Patent No.: US 9,404,492 B2
(45) Date of Patent: Aug. 2, 2016

(54) PUMP DEVICE HAVING A MICRO PUMP AND BEARING MEMBER FOR A MICRO PUMP

(75) Inventors: Sven Reimann, Ludwigslust (DE); Gerald Voegele, Sindelfingen (DE); Thomas Weisener, Schwerin (DE)

(73) Assignee: HNP MIKROSYSTEME GMBH, Schwerin (DE)

( * ) Notice: Subject to any disclaimer, the term of this patent is extended or adjusted under 35 U.S.C. 154(b) by 153 days.

(21) Appl. No.: 14/129,475

(22) PCT Filed: Jun. 15, 2012

(86) PCT No.: PCT/EP2012/061514

§ 371 (c)(1), (2), (4) Date: Apr. 3, 2014

(87) PCT Pub. No.: WO2013/000745

PCT Pub. Date: Jan. 3, 2013

(65) Prior Publication Data

US 2015/0132172 A1 May 14, 2015

(30) Foreign Application Priority Data

Jun. 30, 2011 (DE) ..... 10 2011 051 486

(51) Int. Cl.
*F03C 2/00* (2006.01)
*F03C 4/00* (2006.01)
(Continued)

(52) U.S. Cl.
CPC ..... *F04C 2/10* (2013.01); *F01C 21/108* (2013.01); *F04C 2/086* (2013.01); *F04C 2/102* (2013.01); *F04C 15/0019* (2013.01); *F04C 15/0023* (2013.01); *F04C 15/0088* (2013.01); *F04C 15/06* (2013.01); *F04C 2240/50* (2013.01); *F04C 2240/605* (2013.01)

(58) Field of Classification Search
CPC ..... F04C 2/10; F04C 2/102; F04C 15/06; F04C 15/062; F04C 15/0019; F04C 15/0023; F04C 2240/30; F04C 2240/50; F04C 2240/54; F04C 2240/56; F16C 17/105; F16C 17/107; F16C 33/1085
USPC ..... 418/131–132, 166, 171, 270
See application file for complete search history.

(56) References Cited

U.S. PATENT DOCUMENTS 3,238,883 A 3/1966 Martin
3,824,047 A 7/1974 McDermott
(Continued)

FOREIGN PATENT DOCUMENTS

CH 661323 A5 7/1987
DE 1947798 A 4/1971
(Continued)

OTHER PUBLICATIONS

Alquezar Getan, M; International Search Report for PCT/EP2012/061514, mailed Sep. 3, 2013; European Patent Office; Munich, Germany.

*Primary Examiner* — Theresa Trieu
(74) *Attorney, Agent, or Firm* — Stevens & Showalter LLP

(57) ABSTRACT

The invention relates to a micro pump, comprising an inner rotor arranged on a shaft and an outer rotor, which form a rotor unit including a delivery chamber for fluid, wherein the pump comprises a multi-functional bearing member for the shaft with improved lubrication, to a bearing member for a micro pump and to an operating method.

21 Claims, 3 Drawing Sheets

(51) Int. Cl.

| | |
|---|---|
| ***F04C 2/00*** | (2006.01) |
| ***F04C 2/10*** | (2006.01) |
| ***F04C 15/00*** | (2006.01) |
| ***F04C 2/08*** | (2006.01) |
| ***F04C 15/06*** | (2006.01) |
| ***F01C 21/10*** | (2006.01) |

(56) References Cited

U.S. PATENT DOCUMENTS

| | | | | |
|---|---|---|---|---|
| 3,945,779 | A | 3/1976 | Vlemmings et al. | |
| 6,179,596 | B1 * | 1/2001 | Weisener et al. | 418/171 |
| 7,698,818 | B2 * | 4/2010 | Voegele et al. | 418/166 |
| 2004/0086408 | A1 | 5/2004 | Erdmann et al. | |
| 2004/0228744 | A1 | 11/2004 | Nakano et al. | |
| 2008/0159884 | A1 * | 7/2008 | Nakanishi et al. | 417/410.4 |
| 2013/0294940 | A1 * | 11/2013 | Matz et al. | 417/420 |

FOREIGN PATENT DOCUMENTS

| | | | |
|---|---|---|---|
| DE | 2408824 | A | 10/1974 |
| DE | 3310593 | C2 | 4/1991 |
| DE | 19843161 | A1 | 4/2000 |
| DE | 102008054755 | A1 | 6/2010 |
| DE | 102011001041 | A1 | 5/2012 |
| GB | 1320026 | A | 6/1973 |
| GB | 2119444 | A | 11/1983 |
| WO | 9712147 | A1 | 4/1997 |
| WO | 0017523 | A1 | 3/2000 |
| WO | 02057631 | A2 | 7/2002 |

* cited by examiner

PUMP DEVICE HAVING A MICRO PUMP AND BEARING MEMBER FOR A MICRO PUMP

FIELD OF THE INVENTION

The present invention relates to a pump device including a micro pump, also referred to herein as a micorpump, of small or smallest size, and to a bearing member, also referred to herein as a bearing element, for such a pump. Such a pump serves the purpose of delivering fluid or medium from a low-pressure inlet to a high-pressure outlet and has a dimension of less than 30 mm, preferably less than 20 mm, and most preferably less than 10 mm (maximum dimension of a micro pump, in particular, maximum dimension of the outer diameter of the outer rotor).

BACKGROUND OF THE INVENTION

A generic micro pump operates according to the principle of a gear pump. It comprises an inner rotor with external teeth and an outer rotor with internal teeth. The external teeth of the inner rotor are in meshing engagement with the internal teeth of the outer rotor. The two axes of inner rotor and outer rotor are offset with respect to each other by an eccentricity. Due to this offset of axes, the two rotors engaged with each other define a pump chamber or a plurality of pump chambers therebetween, which cyclically change(s) in size and position due to rotation of the rotors.

Such a micro pump is known, for example, from WO00/17523 A1. An inner rotor and outer rotor are formed and arranged in an intermeshing manner, wherein both the inner rotor and the outer rotor are rotatably arranged in a sleeve. The inner rotor is coupled to a shaft in a torque proof manner. The axis of the outer rotor is offset with respect to the axis of this shaft so that the inner rotor with its outward oriented teeth eccentrically rolls on the inward oriented tooth structure of the outer rotor and axial sealing lines are formed depending on the number of teeth, wherein respective pairs of sealing lines define a delivery chamber. These delivery chambers expand in a direction of rotation on the suction side, take up fluid there and deliver it across a virtual center plane extending through the axis to the pressure side, where the delivery chamber having just passed across continuously decreases in the course of the further rotation until it becomes virtually zero and is returned to the suction side on the opposite side of the center plane. Here, the said pump chamber begins to open again continuously with the rotational movement so that the cycle is completed. The movement described with respect to a delivery chamber simultaneously applies to all existing delivery chambers having a different volume between a respective pair of sealing lines at a current time so that a highly uniform delivery flow results during operation of the pump providing a high capability of miniaturization of the entire micro-system structure.

Generic pumps and micro pumps, especially of the type described above, are accommodated in a housing protecting the pump and sealing it from the environment. A possible housing shape for accommodating such a micro pump is known from a data sheet "Pumpenkopf (pump head) Mzr® 4600" of HNP Mikrosysteme GmbH. This pump head comprises a shaft protruding from the face for coupling a motor thereto. Five disk-shaped elements, as cylinder elements, define a housing structure beginning with a housing shaft seal, a compensating kidney plate and a rotor accommodating plate, followed by a fluid guide and a cover. A bore is provided in the rotor accommodating plate which is eccentrically offset with respect to the axis of the shaft for driving the internal gear so that the outer rotor is mounted off-center in the rotor accommodating plate. The compensating kidney plate is located on one side of the outer rotor and inner rotor and the fluid guide plate directly abuts thereon on the face on the opposite side. Both plates comprise input and output kidneys directed towards the rotor on the side of the fluid supply and compensating kidneys arranged in mirror-image fashion for creating a hydraulic balance on the opposite side. Thus, a U-shaped fluid flow arises from the inlet via the inlet kidney to the rotating pump chambers towards the outlet and back to the outlet, which is guided out radially in data sheet Mzr® 4600.

DE B 33 10 593 (White) shows a housing structure for a pump arrangement realizing, along with a wobble rod, an eccentrically operating gerotor. An outlet is provided centrally at the end not penetrated by the shaft and an inlet is provided radially offset thereto, wherein a plurality of intermediate plates comprising channel segments are provided therebetween. DE A 24 08 824 (McDermott) operates with only three plate-shaped structures and shows the gerotor principle in connection with a compensation of signs of wear of the intermeshing teeth, wherein channel segments are provided in the directly adjacent region between an inner disk and the two outer bearing disks for the shaft. CH A 661 323 (Weber) is also concerned with channel segments in a housing structure composed of a plurality of disks, which structure forms a gear pump in the manner of a kit made up of a plurality of component parts which are easy to assemble, to replace and to be supplemented, while actually describing a housing for accommodating such a pump.

It is disadvantageous in known prior art pumps having a housing that they comprise a great number of individual component parts, especially component parts which need to be manufactured with high precision for reliable operation of the pump. Manufacture must be carried out with very narrow tolerances so that accommodation of the rotors in the housing, which is ultimately determined by the numerous individual component parts, can be effected with sufficient tightness while simultaneously ensuring good mounting. Furthermore, each component part attached to another individual component part must be sufficiently sealed, especially when in contact with moving elements of the pump or penetrated thereby. Shaft seals must be dynamic which results in increased maintenance effort and costs. Assembly is complicated by the great number of parts.

SUMMARY OF THE INVENTION

An object of the present invention is to provide a micro pump which can be realized with a minimized number of precision parts and ease of assembly, with high requirements to precision and optimized in terms of manufacture and low in cost. The sealing of the pump is supposed to be simplified and, in particular, capable of doing without dynamic seals. Finally, lubrication, rinsing and temperature control of the bearings of the micro pump is supposed to be realized in a safe and simple manner despite the small dimensions.

The object of the invention is achieved by a pump device having a micro pump for delivering fluid from a low-pressure inlet to a high-pressure outlet, comprising an inner rotor with external teeth, an outer rotor with internal teeth, and a bearing member, wherein the external teeth of the inner rotor mesh with the internal teeth of the outer rotor, the inner rotor is arranged on a shaft in a torque proof manner, the outer rotor is mounted eccentrically to the inner rotor in a rotor accommodating member in a radial direction so that a fluid chamber, as a delivery chamber, is formed between inner rotor and outer rotor, the bearing member comprises a fluid passage for delivered fluid leading from the delivery chamber to the high-pressure outlet, and the bearing member defines at least one radial bearing for the shaft and an axial bearing for the inner and outer rotors in at least one axial direction. The object is further achieved by a bearing member for a shaft of a micro gear pump having an inner rotor and an outer rotor, wherein a fluid passage for fluid delivered by the micro pump is defined in the bearing member, and the bearing member comprises a first radial bearing and a second radial bearing for the shaft as well as an axial bearing for the inner rotor arranged or capable of being arranged at an end-side accommodating member of the shaft in at least one axial direction.

In one embodiment of the invention, the inner and outer rotors define an annular gear or gerotor pump or an internal gear pump. The external-tooth inner rotor is accommodated in the internal-tooth outer rotor. The axes of rotation of inner rotor and outer rotor are offset by an eccentricity in a radial direction. This is preferably achieved by a corresponding positioning of the shaft carrying the inner rotor relative to the rotor accommodating member mounting the outer rotor. For example, the bearing member, and thus also the shaft radially mounted therein, and the rotor accommodating member can be centered with respect to each other in an axial direction. In this case, a recess in the rotor accommodating member accommodating and mounting the outer rotor is not arranged centrically therein, but is offset by the said eccentricity. The axial centering or positioning of bearing member and rotor accommodating member with respect to each other can be achieved by a housing, especially an annular or sleeve-like housing arranged, at least in part, around the same. This housing is also capable of aligning and centering further elements of the pump, for example the kidney plate, relative to the bearing member and the rotor accommodating member. Alignment of the angular position of bearing member, rotor accommodating member and, if applicable, kidney plate with respect to each other in the axial direction can preferably be achieved by means of a pin element or such like extending therethrough. According to the invention, the thickness of the inner and outer rotors in the axial direction is matched to the thickness of the rotor accommodating member in the axial direction. In particular, the rotor accommodating member may be slightly undersized, preferably within a range of 2 to 10 μm. In accordance with a specific embodiment of the invention, the inner rotor can be driven by the shaft and can, in turn, drive the outer rotor.

Due to the eccentric arrangement of inner rotor and outer rotor in relation to each other, a free volume is provided therebetween defining a delivery chamber or a plurality of delivery chambers. They expand in a direction of rotation on the suction side, take up fluid there and deliver it over to the pressure side, where the delivery chamber(s) continuously decrease(s) in the course of the further rotation. Subsequently thereto, the delivery chamber is returned to the suction side. Here, it begins to open again continuously with the rotational movement so that the cycle is completed. In a gerotor pump, the inner and outer rotors have different numbers of teeth. The teeth roll on each other, thus forming sealing lines on each side of an intermediate tooth space so that each intermediate tooth space constitutes a delivery chamber. The movement described above with respect to a delivery chamber simultaneously applies to all existing delivery chambers of a gerotor pump having a different volume between a respective pair of sealing lines at a current time so that a highly uniform delivery flow results during operation of the pump providing a high capability of miniaturization of the entire micro-system structure. In the case of an annular gear pump, a usually crescent-shaped sealing element is arranged in the free volume between inner rotor and outer rotor sealing the intermediate tooth spaces thereof during rotation. The delivery chambers formed between inner rotor and outer rotor deliver fluid from a low-pressure fluid inlet or inlet kidney to a high-pressure fluid outlet or outlet kidney.

Due to the integration, inherent to the invention, of numerous functions into the bearing member as a single component part, the tolerance chain is advantageously shortened. Individual parts of the pump, such as for example inner rotor and outer rotor, rotor accommodating member, bearing member and, if applicable, kidney plate, are configured such that the necessary, but cost-intensive precision is concentrated on a number of parts as low as possible. The short tolerance chains resulting from the compact structure permit an increase in the tolerances of the individual component parts which results in a further simplification of manufacture and a decrease in manufacturing effort and production costs.

The core of the pump is constituted by the bearing member, the shaft, the set of rotors comprising an inner rotor and an outer rotor, and the rotor accommodating member, possibly supplemented by the kidney plate. The precision required for sufficient hydraulic efficiency is achieved by a precise bearing configuration and rotors manufactured with high precision. The bearing member is the component part with the highest integration of functions. According to the invention, it simultaneously defines a radial bearing for the shaft, an axial bearing for the inner and outer rotors in at least one axial direction, and a fluid passage for fluid delivered by the rotors. Due to this integration of functions, the number of component parts and thus also the number of joints located therebetween can be advantageously reduced as compared to known prior art pumps. Furthermore, all pump-specific tolerances are advantageously combined in a low number of precision parts, namely the bearing member, the rotor accommodating member, the shaft and the set of rotors as well as possibly the housing. Due to the transfer of precision to a limited number of parts, the manufacturing effort is substantially reduced, since less parts must be manufactured with high precision and costs for manufacture and assembly of the individual parts are saved. Finally, a short tolerance chain is realized by the invention. This tolerance chain spans the inner rotor seated on the shaft, the outer rotor and the rotor accommodating member. Short lines of flux are realized by the compact structure.

According to the invention, the radial mounting of the shaft and thus of the inner rotor arranged thereon is achieved by or in the bearing member. Preferably, the shaft is mounted exclusively and directly by the bearing member in a radial direction. The radial bearing(s) is or are preferably placed on one side of the rotor arrangement and configured as a journal bearing. In particular, they can be arranged outside of the actual micro pump so that the bearing diameters can be correspondingly large. In particular, the radial bearing(s) of the shaft can be outside of the fluid guide defined in the bearing member, thereby restricting the diameter of the bearing(s) to a small degree only. All in all, larger bearing diameters are feasible and the occurring bearing forces are minimized, thus enhancing the service life and reliability of the pump. The lubricating film in the bearing builds up more rapidly due to higher sliding speeds resulting from a larger bearing volume.

Preferably, the bearing member comprises a first radial bearing and a second radial bearing, wherein the diameter of the first radial bearing is greater than the diameter of the second radial bearing. According to a specific embodiment, the diameter of the first radial bearing is at least 6 mm, preferably at least 6.5 mm, and the diameter of the second radial bearing is 5 mm at most. Due to the bearing diameters differing in size, one of the two bearings can be matched to the small dimensions of the micro pump and especially to the diameter of the inner rotor. The bearing diameter (of the smaller radial bearing) is determined by the dimensions of the inner rotor arranged on the shaft. Due to assembly, said diameter is larger than the internal diameter or the internal dimensions of the inner rotor arranged on the shaft. In order to enable arrangement and sealing of the inner rotor at the bearing member, said diameter must be smaller than the root circle diameter of the inner rotor. Due to the small dimensions of the inner rotor in micro pumps, the bearing diameter of the bearing on the side of the inner rotor is hence restricted. However, the other bearing, namely the one having the larger bearing diameter, is suited to accommodate relatively high bearing forces.

In one embodiment, the fluid passage is in fluid connection with at least one radial bearing. Preferably, the radial bearings are configured in form of recesses or bores, especially through holes or through bores, in the bearing member. The radial inner surfaces thereof define bearing surfaces of corresponding surface finish and precision for the shaft. The radial bearings formed in the bearing member and the fluid passage are preferably configured and arranged such that they intersect and overlap each other at least in part. The shaft then protrudes, at least in sections, through the fluid passage. The fluid delivered by the micro pump circulates around it. The fluid advantageously enters into the bearing gap of the radial bearings configured as journal bearings and serves as a slip, lubricating and/or rinsing agent here.

It is advantageous that large bearing surfaces with active lubrication can be realized outside of or remote from the actual functional units of the pump. Apart from the above described lubrication of the bearing surfaces, the fluid delivered by the pump and passed through the bearing member may also serve the purpose of controlling temperature (cooling or heating) of the bearing member, the bearing surfaces and further functional units, such as for example magnets for driving the shaft described below. Low wear and increased lifetime result from the active lubrication and cooling and the improved pressure distribution in the radial bearings.

According to a specific embodiment of the invention, a kidney plate can advantageously be arranged on the side of the rotor accommodating member opposite to the bearing member, which kidney plate comprises a fluid supply to and/or a fluid drain from the rotor accommodating member.

While the bearing member defines an axial bearing in one direction, the kidney plate may define an axial bearing for the inner rotor or the outer rotor or both in another axial direction. According to one embodiment of the invention, the face of the bearing member facing the rotor accommodating member may serve as an axial bearing surface and sealing surface for the inner rotor and/or outer rotor. In addition or alternatively thereto, the face of the kidney plate facing rotor accommodating member may serve as an axial bearing surface and sealing surface for the inner rotor and/or the outer rotor. An adequate mounting of the rotor(s) in an axial direction is achieved by a highly precise manufacture of the rotors and the rotor accommodating member. In addition or alternatively to the axial mounting to the kidney plate, the pump can comprise a ceramic or hard metal element arranged on the side of the bearing member opposite to the rotor accommodating member and defining an axial floating bearing for the shaft. This, in particular, pin-shaped ceramic or hard metal element can be arranged in an especially mushroom-shaped PTFE element acting as a spacer between the shaft and/or magnet on the one hand and the upper housing part on the other hand. The shaft is preferably forced towards the kidney plate by the fluid pressure generated by the micro pump. Thus, there is a positive-fit shaft-hub joint between shaft and inner rotor permitting axial displacement of the inner rotor on the shaft.

According to another embodiment of the invention, at least one kidney-shaped cavity can be formed in the rotor-side face of the bearing member. This cavity serves the purpose of high-pressure side draining of the delivery chamber, i.e. the delivery chamber formed between inner rotor and outer rotor. Alternatively or in addition thereto, at least one kidney-shaped cavity can be formed in the rotor-side face of the bearing member, which cavity serves the purpose of low-pressure side charging of the delivery chamber, i.e. the delivery chamber formed between inner rotor and outer rotor. The cavities serve the purpose of fluidic control. Advantageously, the face has a low surface roughness and a narrow-tolerance levelness. In particular, it may serve as a bearing and/or sealing surface for the set of rotors.

Bearing member, shaft, set of rotors consisting of inner rotor and outer rotor, and rotor accommodating member as well as possibly further elements or units in contact with the shaft and the set of rotors, such as e.g. the kidney plate, are preferably accommodated in a hermetically tight housing and do not project therefrom. Owing to such a hermetic structure, dynamic seals (shaft seals) liable to wear can be dispensed with. Long service lives, long overall life and increased product safety result therefrom. The pump can advantageously be used in long-term applications and in chemistry with hazardous or highly volatile media. A complete encapsulation of the functional component parts of the pump, especially of bearing member, rotor accommodating member, kidney plate, shaft and set of rotors, can be achieved by a two or multi-part housing including a lower housing part and a housing cover. The housing cover can be arranged on the lower housing part, in particular, by means of a hold-down device. All moving functional parts or parts coming into direct contact therewith and with the delivered fluid are preferably completely accommodated in the housing and do not project therefrom. Particularly advantageously, the individual component parts of the housing can be sealed against each other by static seals, e.g. O-ring seals. A sealing of moving parts protruding from the housing by means of complex dynamic seals liable to wear is not required. In one embodiment of the invention, the housing is configured such that medium can flow in through the lower housing part and is then, while flowing through the kidney plate, sucked in by the delivery chamber(s) formed between the rotors. Subsequent thereto, the medium is returned via the fluid guide formed in the bearing member through the rotor accommodating member and the kidney plate to the lower housing part. The fluid preferably flows through a cavity surrounded by the housing cover, in which the bearing member is arranged, at least in parts, as well as possibly further functional units of the micro pump. The delivered fluid circulates around the bearing member and possibly said functional units, especially the internal magnet system. Particularly advantageously, fluid enters into the region of and at the radial bearings of the shaft, where it accomplishes lubrication and, in addition or optionally, rinsing. The fluid may also achieve temperature control of the bearing member and further functional units, such as especially the internal magnet system. The fluid preferably flows through a cavity surrounded by the housing cover, in which the bearing member is arranged, at least in part, as well as possibly further functional units of the micro pump. The delivered fluid circulates around the bearing member and possibly said functional units, especially the internal magnet system. Particularly advantageously, the fluid enters into the region of the radial bearings and into the radial bearings of the shaft, where it accomplishes lubrication and, in addition or optionally, rinsing. The fluid may also achieve temperature control the bearing member and further functional units, such as especially the housing cover. The lower housing part can advantageously comprise fluid passages as a supply and drain and can be aligned with respect to the rotor accommodating member in a radial direction, preferably by means of a pin element. In addition, the bearing member can be centered with respect to the lower housing part and the housing by means of the upper housing part.

According to another embodiment of the invention, the pump can comprise a heating and/or cooling device, especially a coolant passage for cooling the upper housing part surrounding the magnet. By integration of a heating/cooling into the pump housing, for example, the cold-starting ability of the pump or temperature-controlled operation thereof can be ensured. This facilitates the use of the pump in chemical industry and in mechanical and plant engineering. For example, the pump can comprise an external housing provided in addition to the housing and defining, together with the upper housing part, a gap space therebetween, through which coolant flows so that a temperature-control medium can flow between housing and external housing.

The pump can preferably be driven by a magnet system. In particular, a magnet can be arranged or formed on the shaft or cooperate therewith. This magnet, referred to as internal magnet in the following for ease of understanding, since it is arranged in the housing of the pump according to one embodiment of the invention, cooperates with an external imprinted rotating magnetic field so that the shaft can be driven rotationally. In the case of a potential offset of internal and external magnet system, forces can be absorbed particularly well in the bearing member due to the above described bearings of the shaft. The external magnet system is preferably located outside of the housing and generates a rotating magnetic field which, in turn, makes the internal magnet rotate together with the shaft. In such a drive using a rotating magnetic field, the functional units of the pump surrounding the internal magnet, such as e.g. the bearing member and the housing cover, can readily be made of metal in accordance with the invention, since undesired heating caused, for example, by eddy currents can be avoided due to the fluid delivered by the pump and/or an additional coolant. Rotation of the external magnet system outside of the housing can be achieved by means of a permanent magnet system. The internal magnet system seated on the shaft as well as external magnets, if any, is/are preferably made of higher-quality magnetic materials, such as NdFeB or SmCo. The internal magnet system can additionally be encapsulated so that aggressive media can be delivered as well.

Preferably, oxide ceramics, non-oxide ceramics or hard metal are used as materials for the bearing member, rotor accommodating member, kidney plate, shaft and rotors. As a result of this, high stability is achieved. The use of cured steels or plastic materials is possible as well.

BRIEF DESCRIPTION OF THE DRAWINGS

Embodiments of the invention are apparent from the following description with reference to the Figures being non-limiting for the claims, wherein:

DETAILED DESCRIPTION OF THE INVENTION

Figure 1:
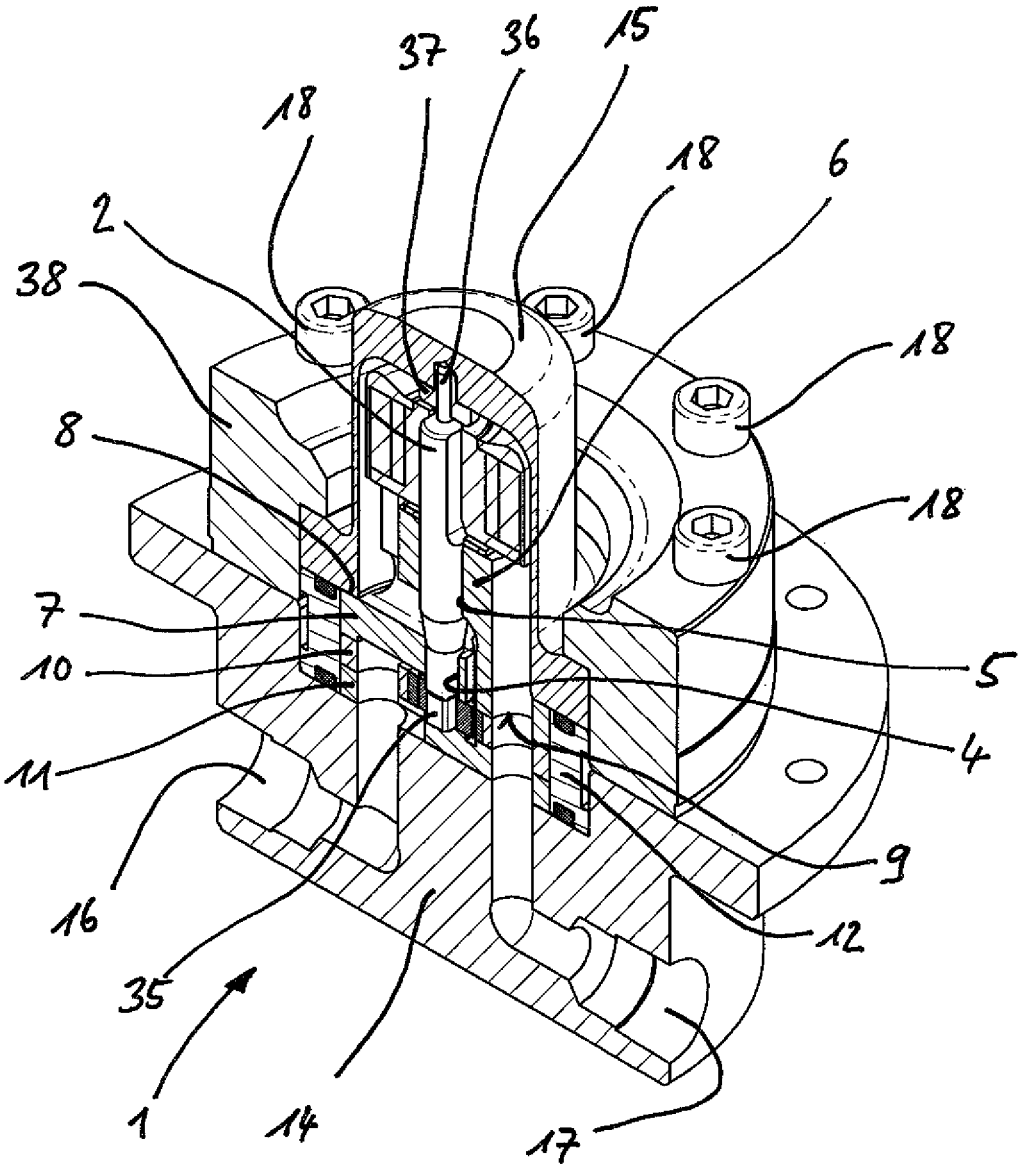
FIG. 1 shows a first embodiment of a pump device in a perspective schematic and partial-sectional view (low-pressure variant)
Figure 2:
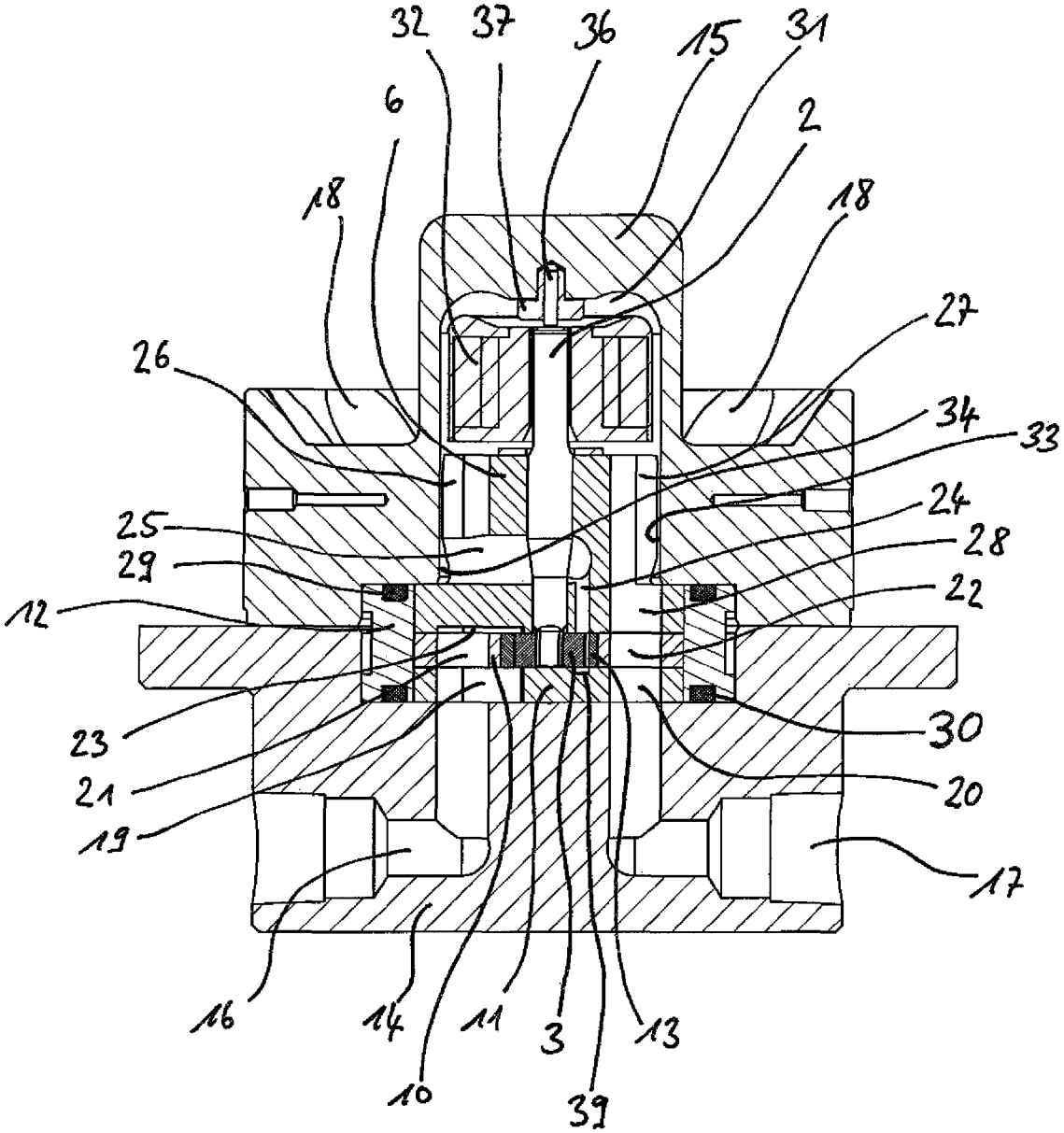
FIG. 2 shows a second embodiment of a pump device in a sectional view (high-pressure variant)
Figure 3:
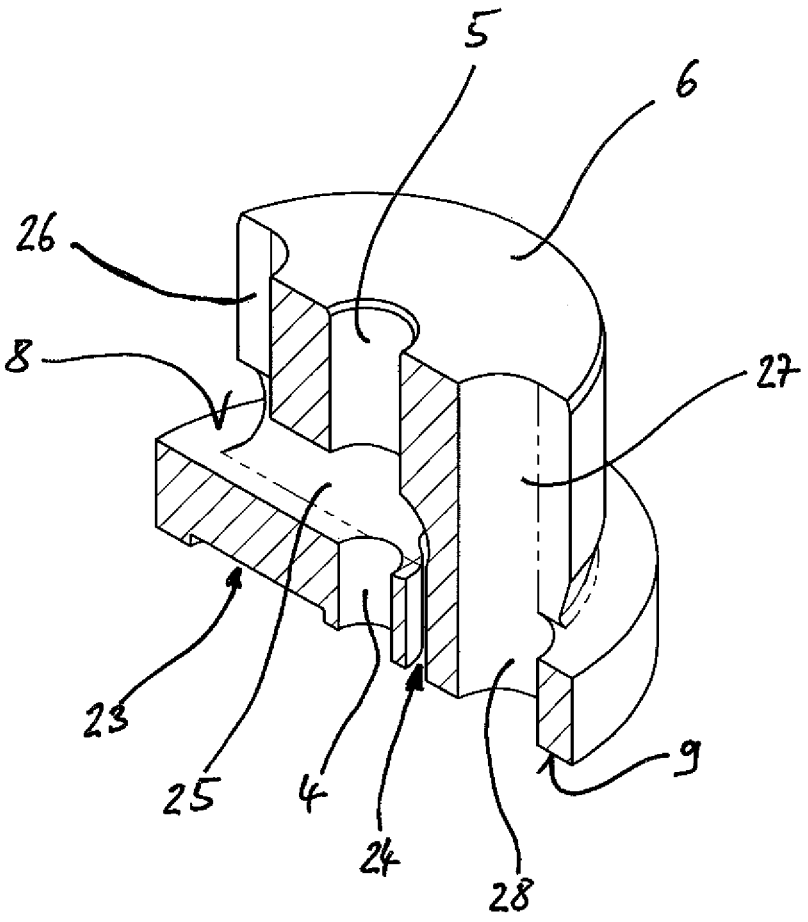
FIG. 3 shows a perspective sectional view of the bearing member for the micro pump of FIGS. 1 and 2.

The pump device 1 according to the invention shown in FIG. 1 is adapted for a pressure range of 0 bar to 60 bar. The pump holds a micro pump as an annular gear pump and comprises a shaft 2, on the end of which, the lower one in the Figure, an inner rotor 3 is arranged (shown in FIG. 2). For this purpose, the lower end of the shaft 2 defines a polygonal accommodating member 35, on which the inner rotor 3 is arranged in a torque proof manner.

The shaft 2 is accommodated in a bearing member 6 by means of a first radial bearing 4 and a second radial bearing 5 and is mounted in a radial direction. A rotor accommodating plate 10, as the rotor accommodating member, is arranged adjacent to the face 9, the lower one in FIGS. 1 and 2, of the bearing member 6. A kidney plate 11 is arranged on the side of the rotor accommodating plate 10 opposite to the bearing member 6. The bearing member 6 is substantially cylindrical and comprises a region 7 at its end, the lower one in the Figure, which is expanded compared to its residual diameter so that an annular circumferential contact shoulder 8 is formed. Bearing member 6, rotor accommodating plate 10 and kidney plate 11 are aligned and centered with respect to each other in a radial direction by a sleeve 12 defining a housing.

In the region of the first radial bearing 4 located close to the rotor, the shaft 2 comprises a first diameter. In the region of the second radial bearing 5 located remote from the rotor, the shaft 2 comprises a wider diameter compared to the first diameter. Due to the large bearing diameter at the radial bearing 5 remote from the rotor, the occurring bearing forces are low. The recess in the bearing member 6 accommodating the shaft 2 is centered with respect to the expanded region 7 thereof. In the rotor accommodating plate 10, which is centered in relation to the bearing member 6 and the shaft 2 by the sleeve 12, a recess is formed, which is off-center due to an eccentricity E, in which recess an outer rotor 13 (not shown in FIG. 1) is accommodated also in an off-center manner and mounted in a radial direction. The inner rotor 3 arranged on the shaft 2 in a torque proof manner is located within the outer rotor 13. Rotor 3 together with the shaft 2 are eccentric with respect to the recess in the rotor accommodating plate 10 and the outer rotor 13. The inner rotor 3 is provided with external teeth and the outer rotor 13 is provided with internal teeth. These teeth are in meshing engagement with each other. Due to the said eccentricity, a delivery cavity is formed between inner rotor and outer rotor which is not apparent from the Figures.

The face 9 of the bearing member 6 facing the inner rotor 3 is configured as an axial bearing for the inner rotor 3 and the outer rotor 13. For this purpose, the face 9 has a low surface roughness, for example, in a range of Ra 0.1, and a narrow-tolerance levelness. On the side opposite to the set of rotors (on the top in the Figures), a pin 36 is received in a PTFE sleeve 37 within a pot-shaped cover 15, as the housing cover. Pin 36 and PTFE sleeve 37 form an axial floating bearing for the shaft 2 and serve as spacers for an internal magnet 32 described below.

The height of the sleeve 12 in the axial direction of the shaft 2 is matched to the thicknesses of kidney plate 11, rotor accommodating plate 10 and expanded region 7 and is slightly smaller than the sum of the thicknesses of said components so that they are centered by the sleeve 12 and trapped by a lower housing part 14 and a cover 15, as the housing cover, in a defined manner in the axial direction. The thickness of inner rotor and outer rotor in the axial direction of the shaft 2 is matched to the thickness of the rotor accommodating plate 10 so that inner rotor and outer rotor can rotate therein and between the face 9 of the bearing member 6 and the kidney plate 11 as axial bearings as smoothly as required, while simultaneously being tight.

The lower housing part 14 comprises an inlet passage 16 (low-pressure connection) and an outlet passage 17 (high-pressure outlet). The cover 15 is relatively massive in shape in the high-pressure variant of the pump shown in FIG. 2 and locked with the lower housing part 14 by a threaded flange connection 18. In the low-pressure variant shown in FIG. 1, the cover 15 is less massive in shape and is not arranged directly on the lower housing part 14 but via a hold-down device 38 and is locked with the sleeve 12. The hold-down device 38 is not contacted by fluid and can thus be made of a less high-quality material. On its side facing the cover 15, the lower housing part 14 comprises a recess in which the sleeve 12 and the elements accommodated therein, i.e. kidney plate 11 and rotor accommodating plate 10, are received. The lower housing part 14 is centered via this recess by the sleeve 12. Furthermore, it is angularly positioned with respect to the kidney plate 11 by a pin not shown in the Figures.

The kidney plate 11 is made of ceramics and comprises a low-pressure side inlet kidney 19 and a high-pressure side outlet opening 20. Due to the radial alignment of the kidney plate 11 with the lower housing part 14, the low-pressure side inlet passage 16 of the lower housing part 14 opens into the inlet kidney 19, whereas the outlet opening 20 is connected to the high-pressure side outlet passage 17. Furthermore, the inlet kidney 19 is configured such that it overlaps with the central recess of the rotor accommodating plate and especially with the delivery chamber formed therein by the inner rotor 3 and the outer rotor 13 and is in fluid connection therewith.

Apart from the central recess for the outer rotor 13, two passages are formed in the rotor accommodating plate 10, i.e. an inlet opening 21 on the low-pressure side and an outlet opening 22 on the high-pressure side. An inlet kidney 23 is formed in the face 9 of the bearing member 6. The inlet kidney 19 of the kidney plate 11 and the inlet kidney 23 of the bearing member 6 overlap with the inlet opening 21 and are connected to each other. Furthermore, the inlet kidney 23 of the bearing member 6 overlaps with the central recess of the rotor accommodating plate and especially with the delivery chamber formed therein by the inner rotor 3 and the outer rotor 13 and is in fluid connection therewith. All in all, a first low-pressure side supply to the delivery chamber is provided by the inlet passage 16 and the inlet kidney 19 and a second low-pressure side supply to the delivery chamber is provided by the inlet passage 16, the inlet kidney 19, the inlet opening 21 and the inlet kidney 23. Due to this second low-pressure side supply, hydraulic balance or hydraulic compensation is provided at the set of rotors and a major low-pressure side inflow is formed. Furthermore, there is less cavitation.

A high-pressure side fluid passage is defined in the bearing member 6. This fluid passage substantially consists of an outlet kidney 24, a blind counter bore 25 provided in a radial direction, a first peripheral recess 26 and a second peripheral recess 27 including a subsequent high-pressure outlet 28. The high-pressure outlet 28 overlaps with the outlet opening 22 of the rotor accommodating plate 10 and is in fluid connection with the high-pressure side outlet passage 17 via said outlet opening and outlet opening 20. The first and second peripheral recesses 26, 27 are provided in the periphery of the bearing member 6 and are open in an axial direction (upwards in the Figures) and in a radial direction towards the outside of the bearing member 6. A compensating kidney 39 is formed in the kidney plate 11 opposite to the outlet kidney 24. Said compensating kidney generates hydraulic balance or hydraulic compensation at the set of rotors on the high-pressure side.

As already explained, the cover 15 is locked with the lower housing part 14 by the threaded connection 18 and sealed thereto by two O-ring seals 29, 30 in the sleeve 12. The cover 15 comprises a central recess 31, in which the bearing member is accommodated along with the shaft 2 mounted therein together with an internal magnet 32 described in greater detail below. A gap 34 forming a part of the high-pressure side fluid passage is provided between the radial outer surface 33 of the bearing member 6 and the internal wall of the recess 31 facing the bearing member 6. Compressed fluid flows out of the delivery chamber via the outlet kidney 24 and the blind counter bore 25 into the first peripheral recess 26. From there, the fluid is distributed via the gap 34 around the entire head region of the bearing member 6 into the intermediate space between bearing member 6 and cover 15. Subsequently thereto, the fluid flows from this intermediate space via the second peripheral recess 27, the high-pressure outlet 28, the outlet opening 22 of the rotor accommodating plate 10 and the outlet opening 20 towards the high-pressure side outlet passage 17. Due to the fluid flowing in the cavity surrounded by the cover 15, especially the fluid flowing in the intermediate space between bearing member 6 and cover 15, both the bearing member 6 with all functional units contained therein (e.g. radial bearing 5 remote from the rotor) and the internal magnet 32 as well as the split pot are temperature controlled, especially cooled. In particular, the radial bearings 4, 5 are lubricated and/or rinsed.

This cooling is advantageous, especially in view of the drive of the pump by the internal magnet 32. The internal magnet 32 is arranged on the end of the shaft 2 remote from the rotor in a torque proof manner. It cooperates with an external magnet system, which is not shown in the Figures and is arranged outside of the hermetic housing of the pump formed by the lower housing part 14 and the cover 15. The external magnet system generates a rotating magnetic field which makes the internal magnet 32, configured as a permanent magnet, rotate about the axis of rotation of the shaft 2. The shaft rotates together with the inner rotor 3 arranged thereon, which meshes with the outer rotor 13 and makes it rotate in the recess in the rotor accommodating plate 10 accommodating it. Due to the rotating magnetic field of the magnets, inductive heating occurs depending on the kind of material used for the cover 15 and the bearing member 6, wherein the generated heat can be dissipated by the fluid flowing through the cover 15.

A further advantage of delivering of the medium through the cavity surrounded by the cover 15 is that failure of the pump due to accumulated gas bubbles can be excluded. Clearance volume is minimized due to the active flow through the entire pump including the pot-shaped cover 15.

The invention claimed is:

1. A pump device comprising a micro pump for delivering fluid from an inlet to an outlet having higher pressure than the inlet, the pump device comprising a micro pump having:

an inner rotor (3) with external teeth;

an outer rotor (13) with internal teeth; and a bearing member (6);

wherein the external teeth of the inner rotor mesh with the internal teeth of the outer rotor upon rotation; and the inner rotor (3) is fastened to a rotatable shaft (2) and the outer rotor (13) is mounted eccentrically to the inner rotor (3) in a rotor accommodating member (10)

in a radial direction providing a delivery chamber between the inner rotor and the outer rotor;

the bearing member (6), the shaft (2), the inner rotor (3), the outer rotor (13) and the rotor accommodating member (10) are provided in a hermetically tight housing including a housing cover (15) and a lower housing part (14);

the bearing member (6) comprises a fluid passage between the delivery chamber and the outlet and the fluid passage is configured to guide the fluid through the bearing member (6) and a cavity surrounded by the housing cover (15) wherein the bearing member (6) is accommodated;

the bearing member (6) is configured to provide at least one radial bearing (4, 5) for the rotatable shaft (2) and an axial bearing (9) for the inner and outer rotors in at least one axial direction; and the at least one bearing is configured as a journal bearing.

2. The pump device according to claim 1, wherein the bearing member (6) comprises a first radial bearing (5) and a second radial bearing (4), wherein the diameter of the first radial bearing (5) is greater than the diameter of the second radial bearing (4).

3. The pump device according to claim 2, wherein the diameter of the first radial bearing (5) is at least 6 mm and the diameter of the second radial bearing is less than 5 mm.

4. The pump device according to claim 1, wherein the fluid passage forms a fluid connection with the at least one radial bearing (4, 5).

5. The pump device according to claim 1, wherein the rotatable shaft (2) extends through a portion of the fluid passage in the bearing member (6).

6. The pump device according to claim 1, wherein a kidney plate (11) is arranged on the side of the rotor accommodating member (10) opposite to the bearing member (6), the kidney plate comprising one of a fluid supply (19) to and a fluid drain (20) from the rotor accommodating member (10).

7. The pump device according to claim 6, wherein the kidney plate (11) defines an axial bearing for one or more of the inner rotor and outer rotor and the shaft (2).

8. The pump device according to claim 1, wherein the bearing member (6) and the rotor accommodating member (10) are axially centered with respect to each other.

9. The pump device according to claim 8, wherein the kidney plate (11) is axially centered with the bearing member (6) and the rotor accommodating member (10).

10. The pump device of claim 8, wherein the axial centering is provided by a housing (12).

11. The pump device according to claim 1, wherein at least one kidney-shaped cavity (24) is formed in a rotor-side face (9) of the bearing member (6), the at least one kidney-shaped cavity acting to drain the delivery chamber formed between inner rotor and outer rotor.

12. The pump device according to claim 1, wherein at least one kidney-shaped cavity (23) is formed in a rotor-side face of the bearing member (9), the at least one kidney-shaped cavity (23) configured to charge the delivery chamber formed between inner rotor and outer rotor.

13. A bearing member for supporting a rotatable shaft of a micro gear pump having an inner rotor and an outer rotor, the inner rotor being attached to an end portion of the rotatable shaft, wherein:

a fluid passage provided in the bearing member and having a portion (25) that is radially oriented in the bearing member, the fluid passage configured for fluid delivered by the micro pump; and the bearing member (6) comprises a first radial bearing and a second radial bearing for supporting the shaft (2), the bearing member further having an axial bearing (9) for supporting at least the inner rotor in an axial direction.

14. The bearing member according to claim 13, wherein a diameter of the first radial bearing is greater than a diameter of the second radial bearing.

15. The bearing member according to claim 13, wherein a diameter of the first radial bearing is at least 6 mm and a diameter of the second radial bearing is less than 5 mm, and wherein the fluid passage is in a fluid connection with at least one of the first and second radial bearings.

16. The bearing member according to claim 13, wherein the bearing member (6) comprises an axial bearing (9) for the outer rotor of the micro pump as well.

17. The bearing member according to claim 13, wherein the radially oriented portion of the fluid passage is placed in the bearing member to separate the first and second radial bearings.

18. The bearing member according to claim 13, wherein the fluid passage having the radially oriented portion (25) and axial portions (26, 27) in the bearing member.

19. The bearing member according to claim 13, wherein one radial bearing is axially longer than the other radial bearing.

20. The bearing member according to claim 13, wherein the first radial bearing being axially longer and having greater diameter than the second radial bearing, and the first radial bearing being further away from the micro gear pump than the second radial bearing.

21. A pump device having a micro pump for delivering fluid from an inlet to an outlet having higher pressure than the inlet, the pump device comprising:

an inner rotor (3) with external teeth;

an outer rotor (13) with internal teeth; wherein the external teeth of the inner rotor mesh with the internal teeth of the outer rotor, and a bearing member (6);

wherein:

the inner rotor is secured to a rotatable shaft (2) and the outer rotor is mounted eccentrically to the inner rotor in a rotor accommodating member (10) in a radial direction;

the bearing member, (6), the shaft, the inner rotor, the outer rotor and the rotor accommodating member are provided in a hermetically tight housing including a housing cover and a lower housing part, and having a cavity surrounded by the housing cover wherein the bearing member is accommodated;

the bearing member (6) comprises a fluid passage configured to guide the fluid through the bearing member;

the bearing member (6) is configured to provide all radial bearings for the rotatable shaft (2) and an axial bearing for the inner and outer rotors (3, 13).

* * * * *